US009040846B2

(12) United States Patent
Suzuki et al.

(10) Patent No.: US 9,040,846 B2
(45) Date of Patent: May 26, 2015

(54) SHIELDED CABLE FIXING STRUCTURE

(75) Inventors: Toru Suzuki, Kakegawa (JP); Hajime Kato, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/122,261

(22) PCT Filed: Jun. 29, 2012

(86) PCT No.: PCT/JP2012/066795
§ 371 (c)(1),
(2), (4) Date: Nov. 26, 2013

(87) PCT Pub. No.: WO2013/002396
PCT Pub. Date: Jan. 3, 2013

(65) Prior Publication Data

US 2014/0097015 A1 Apr. 10, 2014

(30) Foreign Application Priority Data

Jun. 29, 2011 (JP) ..... 2011-144498

(51) Int. Cl.
*H01R 13/648* (2006.01)
*H01R 13/6581* (2011.01)

(52) U.S. Cl.
CPC ..... *H01R 13/648* (2013.01); *H01R 13/6581* (2013.01); *H01R 2201/26* (2013.01)

(58) Field of Classification Search
USPC ..... 174/359, 664; 439/98
See application file for complete search history.

(56) References Cited

U.S. PATENT DOCUMENTS

| | | | | |
|---|---|---|---|---|
| 5,401,177 | A * | 3/1995 | Dutton et al. | 439/98 |
| 5,406,032 | A * | 4/1995 | Clayton et al. | 174/151 |
| 6,036,543 | A | 3/2000 | Panis et al. | |
| 6,595,789 | B2 * | 7/2003 | Oota et al. | 439/98 |
| 6,793,532 | B2 * | 9/2004 | Saito et al. | 439/607.41 |
| 7,597,580 | B1 | 10/2009 | Advey et al. | |
| 7,915,545 | B1 * | 3/2011 | Bixler et al. | 174/664 |

(Continued)

FOREIGN PATENT DOCUMENTS

| | | |
|---|---|---|
| JP | 2002-289307 A | 10/2002 |
| JP | 2004-119047 A | 4/2004 |

(Continued)

OTHER PUBLICATIONS

International Search Report dated Jul. 24, 2012 issued in International Application No. PCT/JP2012/066795 (PCT/ISA/210).

(Continued)

*Primary Examiner* — Hung V Ngo
(74) *Attorney, Agent, or Firm* — Sughrue Mion, PLLC

(57) ABSTRACT

A shielded cable fixing structure includes a shielded cable that includes an electric wire, a braid for covering the electric wire, and a sheath for covering the braid, an insulation housing that receives a terminal fitting electrically connected to the electric wire, a pair of split shield shells in which the insulation housing is mounted, a groove-shaped portion press-formed on a section of each of the split shield shells to cover a wire lead-out port of the insulation housing, from which the electric wire is led out, and is recessed on an outer surface of each of the split shield shells, and a braid fixing member fixed on an annular mounting groove constituted by the groove-shaped portions of the split shield shells, in a state where the braid is disposed between the annular mounting groove and the braid fixing member.

3 Claims, 7 Drawing Sheets

(56) References Cited

U.S. PATENT DOCUMENTS

| | | | | |
|---|---|---|---|---|
| 2001/0027040 | A1* | 10/2001 | Yoshioka et al. | 439/98 |
| 2002/0048994 | A1 | 4/2002 | Oota et al. | |
| 2002/0134565 | A1 | 9/2002 | Hashizawa et al. | |
| 2002/0173181 | A1* | 11/2002 | Matsumoto | 439/98 |
| 2004/0057187 | A1 | 3/2004 | Kuboshima et al. | |
| 2011/0045701 | A1 | 2/2011 | Tsuruta | |
| 2012/0058674 | A1 | 3/2012 | Deno et al. | |
| 2013/0056256 | A1* | 3/2013 | Guillanton et al. | 174/359 |

FOREIGN PATENT DOCUMENTS

| | | | |
|---|---|---|---|
| JP | 2009-123461 | A | 6/2009 |
| JP | 2010-170778 | A | 8/2010 |
| JP | 2010-268562 | A | 11/2010 |
| JP | 2011-44354 | A | 3/2011 |

OTHER PUBLICATIONS

Written Opinion dated Jul. 24, 2012 issued in International Application No. PCT/JP2012/066795 (PCT/ISA/237).

Written Opinion dated Jul. 24, 2012, issued in counterpart International Application No. PCT/JP2012/066795.

Search Report dated Feb. 9, 2015, issued by the European Patent Office in counterpart European Application No. 12805342.8.

Office Action dated Feb. 3, 2015, issued by the Japanese Patent Office in counterpart Japanese Application No. 2011-144498.

* cited by examiner

SHIELDED CABLE FIXING STRUCTURE

TECHNICAL FIELD

The present invention relates to a shielded cable fixing structure for attaching a shielded cable to a shied shell.

BACKGROUND ART

As a shielded connector attached on an end portion of a shielded cable used for electric power supplying and wiring in various vehicles, such as hybrid vehicles, ones as disclosed in PTL1 and the like have been known.

As shown in FIG. 6, a shielded connector 501 has a shield ring 505, through which a shielded cable 503 extends, and a shield shell 517. Also, the shield shell 517 includes a small diameter portion 513 of a hollow cylindrical shape, through which a core wire and an insulation cover 511 of the shielded cable 503 with a braid 507 and a sheath 509 peeled therefrom extend, and also of which an outer circumference is covered with an end portion of the peeled braid 507, and a body portion 515 of a hallow cylindrical shape, which is provided to extend from the small diameter portion 513, and through which the core wire and the insulation cover 511 extend. In addition, the body portion 515 of the shield shell 517 has therein an inner holder 519 fixed in a state where the core wire and the insulation cover 511 of the shielded cable 503 extend therethrough.

Also, when the shielded connector 501 is fixed to the shielded cable 503, as shown in FIG. 3, the sheath 509 is cut by a required length from one end of the shielded cable 503, thereby exposing the braid 507. Then, crimping dies 523 and 524 are set to sandwich a section, where the small diameter portion 513 of the shield shell 517, a folded portion 521 (see FIG. 6) of the braid 507 of the shielded cable 503, and the shield ring 505 are stacked, from upper and lower sides thereof.

Then, after a core 527 is set to be inserted into the small diameter portion 513 of the shield shell 517, the crimping dies 523 and 525 are fastened to each other, thereby crimping the shield ring 505. The core 527 has a high rigidity, and thus pushes back the small diameter portion 513 from the inside against an external force when the shied ring 505 is crimped against the small diameter portion 513 by fastening the crimping dies 523 and 525. Namely, deformation of the small diameter portion 513 involved with the crimping processing of the shield ring 505 can be inhibited by the core 527. After the crimping operation is completed, the crimping dies 523 and 525 are separated and also the core 527 is pulled out. Thus, the braid 507 can be firmly fixed to the shield shell 517.

CITATION LIST

Patent Literature

PTL 1: JP-A-2010-268562
PTL 2: JP-A-2011-44354
PTL 3: JP-A-2010-170778

SUMMARY OF INVENTION

Technical Problem

However, the conventional shielded connector 501 as described above has a problem in that the manufacturing cost is expensive because facilities, such as the core 527 and the crimping dies 523 and 525, are used when crimping the shield ring 505.

Also, there is a risk in that the shield shell 517 is deformed upon crimping so that fitting to an equipment side and grounding can become unstable. In addition, a deformed portion and electric wires are contacted to each other, and thus damage of the electric wires is also concerned.

Contrarily, techniques, in which, by manufacturing a shield shell by die-casting, a core is not required and crimping is performed by only an external operation using a tool, thereby fixing a braid, are disclosed in PTL 2 and PTL 3. However, there is a problem in that, because the shield shell is manufactured by die-casting, the weight is increased and the manufacturing cost becomes excessively expensive.

The present invention has been made keeping in mind the above problems, and an object thereof is to provide a shielded cable fixing structure, in which the structure is simplified, component costs are reduced, facilities used during assembly are reduced, and also connection stability is improved.

Solution to Problem

The above object of the present invention is achieved by the following configurations.

(1) A shielded cable fixing structure, including: a shielded cable including an electric wire, a braid for covering the electric wire, and a sheath for covering the braid; an insulation housing for receiving a terminal fitting electrically connected to the electric wire; a pair of split shield shells formed in a half-cylindrical shape, wherein the insulation housing is mounted inside the pair of split shield shells; a groove-shaped portion press-formed on a section of each of the split shield shells intended to cover a wire lead-out port of the insulation housing, from which the electric wire is led out, and thus recessed on an outer surface of each of the split shield shells along a circumferential direction of the electric wire extending therethrough; and a braid fixing member fastened and fixed on an annular mounting groove constituted by the groove-shaped portions of the pair of the split shield shells fitted and fixed to each other, in a state where an end portion of the braid is disposed between the annular mounting groove and the braid fixing member.

According to the shielded cable fixing structure of the configuration of the above (1), a pair of split shield shells are fitted and fixed to each other, and thus the groove-shaped portions each formed thereon constitute the annular mounting groove. The end portion of the braid is sheathed on the annular mounting groove and the fixing band is fixed from the outside of the end portion, so that the shielded cable is fixed to the split shield shells by a simple structure. Namely, the split shield shells may be formed by a sheet metal material, and therefore, the fixing structure becomes lightweight and inexpensive, as compared to a conventional shield shell manufactured by die-casting. In addition, the end portion of the braid sheathed on the annular mounting groove is fastened by the fixing band to be structurally prevented from falling out. Thus, assembly may be performed without using a core, crimping dies or the like for crimping and plastically deforming a conventional shield ring. Because crimping is not required, deformation of the split shield shells is hardly occurred, and also an unstable grounding or a damage of the electric wire due to contact between a deformed portion and the electric wire is hardly occurred.

(2) The shielded cable fixing structure according to the above (1), wherein the pair of split shield shells include a first split shield shell for covering a portion of a section of the insulation housing, which is intended to cover the wire lead-out port, and a second split shield shell for covering the other portion of the section of the insulation housing, which is intended to cover the wire lead-out port, and a body portion.

According to the shielded cable fixing structure of the configuration of the above (2), the second split shield shell may seamlessly and integrally cover the other portion of the section of the insulation housing, which is intended to cover the wire lead-out port, and the body portion, thereby achieving a good shield property.

(3) The shielded cable fixing structure according to the above (2), wherein a positioning boss is provided on an outer surface of the insulation housing and is engaged to a positioning hole provided on the second split shield shell.

According to the shielded cable fixing structure of the configuration of the above (3), when the insulation housing is covered with the first and second split shield shells, the second split shield shell is firstly positioned on the insulation housing by engaging the positioning hole to the positioning boss of the insulation housing. Then, the first split shield shell is fixed to the second split shield shell, which is positioned on the insulation housing, and thus, the first and second split shield shells are positioned and fixed on the insulation housing at high accuracy.

In the foregoing, the present invention has been briefly described. Also, details of the present invention will be further apparent, when modes (hereinafter, referred to as "embodiments") for embodying the invention as described below are thoroughly read with reference to the accompanying drawings.

DESCRIPTION OF EMBODIMENTS

A fixing structure of a shielded cable according to one embodiment of the present invention will be now described in detail with reference to the accompanying drawings.

Figure 1:
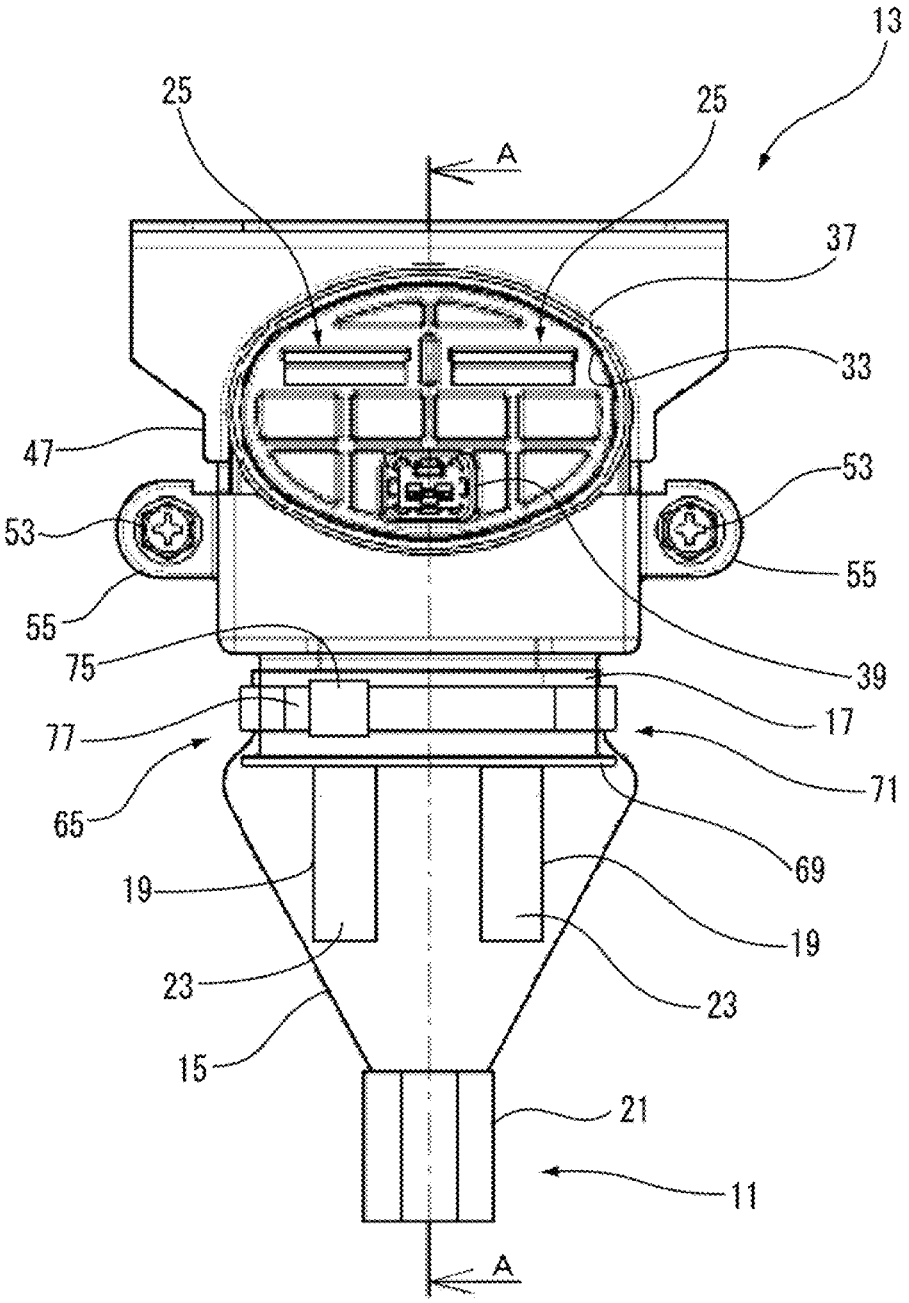
FIG. 1 is a front view showing a shielded connector having a fixing structure of a shielded cable according to a first embodiment of the present invention.
Figure 2:
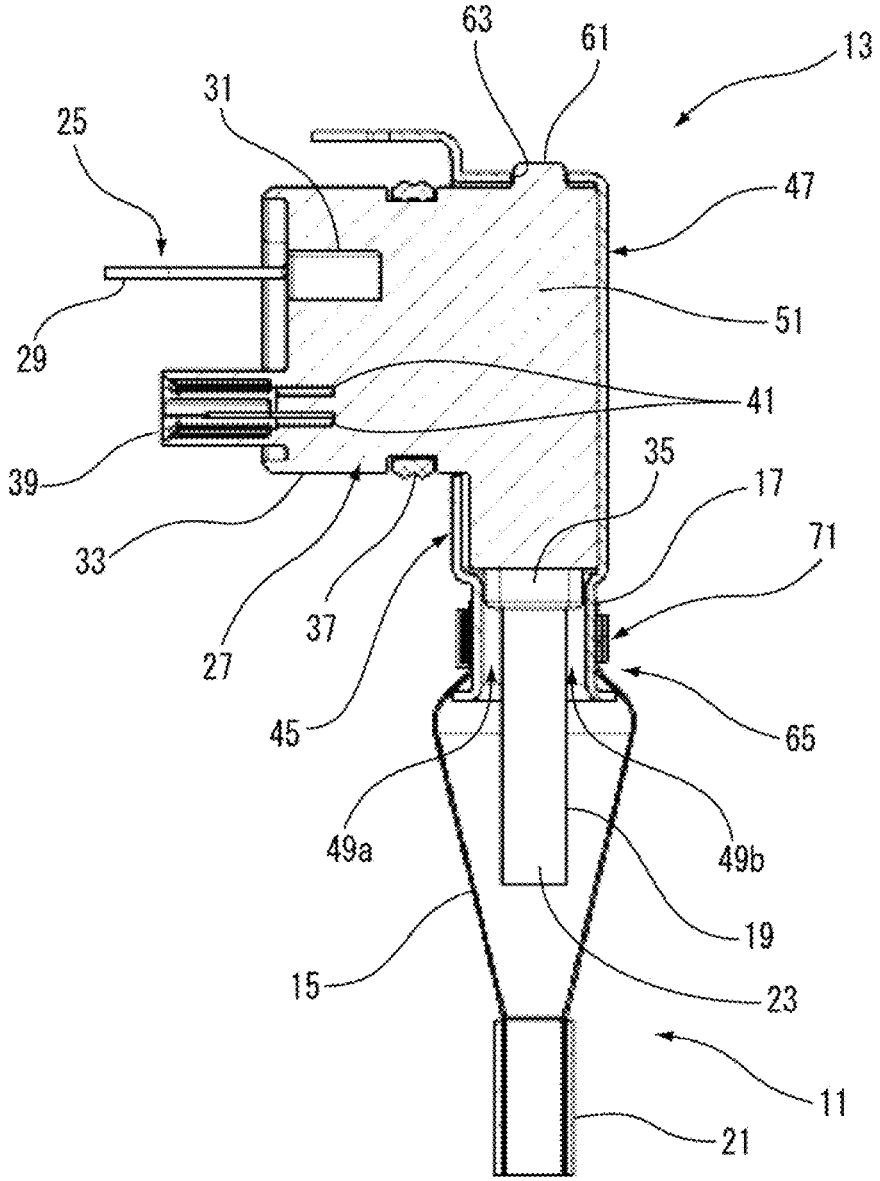
FIG. 2 is a sectional view of the shielded connector shown in FIG. 1 as viewed in a direction of arrow A-A.
Figure 3:
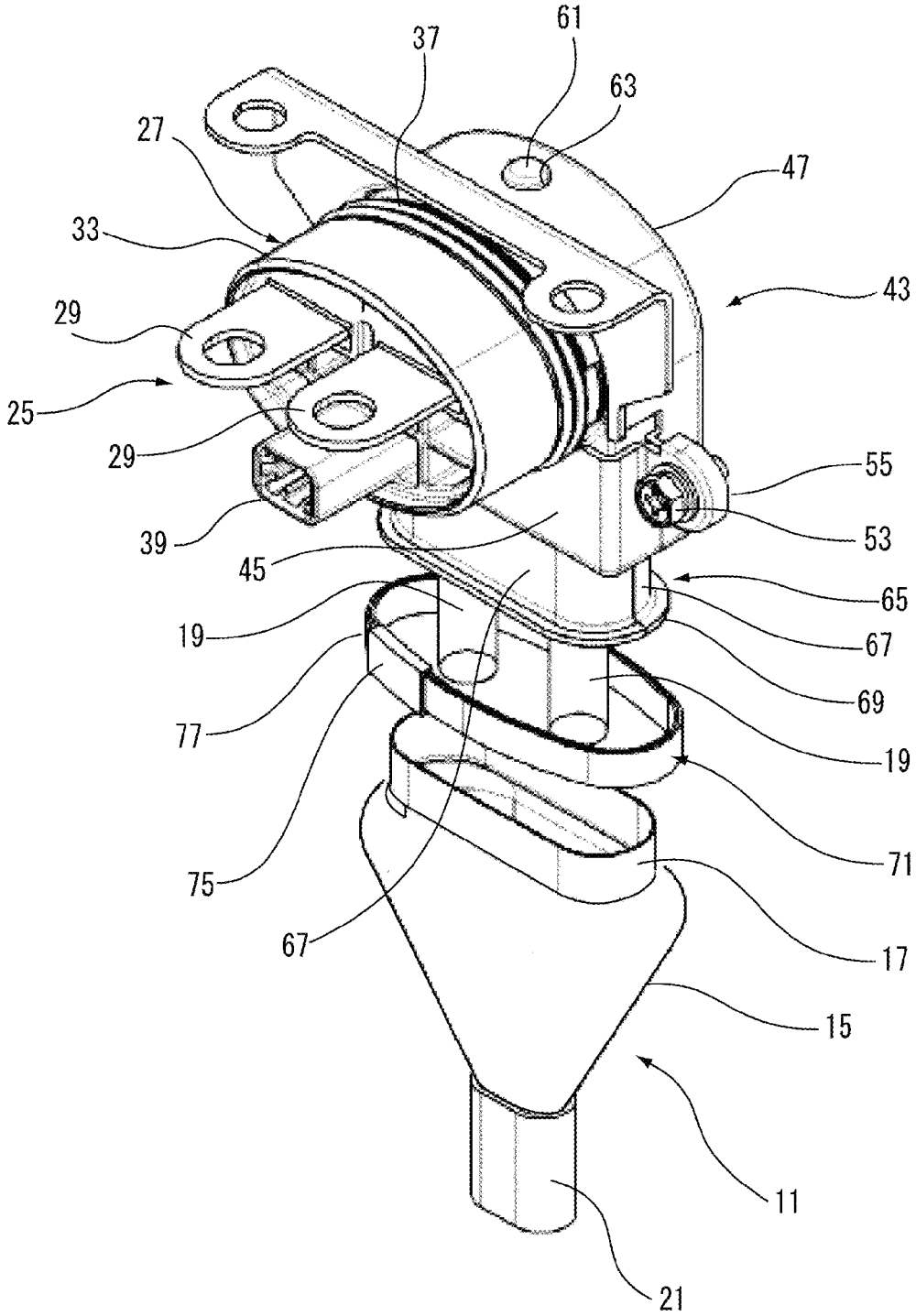
FIG. 3 is an exploded perspective view of the shielded connector shown in FIG. 1.

As shown in FIGS. 1 to 3, a shielded connector 13 having a shielded cable fixing structure according to one embodiment of the present invention is, for example, mounted and used in an inverter device of an electric vehicle to electrically connect between the inverter device and a motor for an in-vehicle electrical equipment.

A shielded cable 11 includes electric wires 19, a braid 15 for covering the electric wires 19, and a sheath 21 for covering the braid 15. The electric wires 19 are constituted of a core wire in the center thereof, and an insulation cover 23 formed by an insulator, such as an insulating resin, for covering an outer circumference of the core wire. The shielded cable 11 of the present invention has a configuration in which two wires are shielded together, but, may have a configuration in which a single wire is shielded or three or more wires are shielded together. In addition, the braid 15 may be provided, on an end portion 17 thereof, with a folded portion, which has been previously folded inward (or outward) by a desired length.

The shielded connector 13 is configured such that a terminal fitting 25 connected to the electric wires 9 is received in the insulation housing 27. The terminal fitting 25 is formed by press processing a good conductive metal plate, and a barrel 31 provided on a rear side of a connection portion 29 thereof is received in the insulation housing 27. The barrel 31 provided on the rear side of the connection portion 29 is crimped and fixed to end portions of the core wires of the electric wires 19, which are exposed by peeling the covers. Also, the connection portion 29 is fitted to a terminal received in a corresponding equipment side shielded connector, not shown.

The insulation housing 27 is made of an insulating resin, and includes a fitting cylindrical portion 33 of an elliptic cylindrical shape, from which the connection portion 29 of the terminal fitting 25 protrudes, and a wire lead-out port 35 for leading out the electric wires 19 along an axis perpendicular to an axis of the fitting cylindrical portion 33. Namely, the insulation housing 27 is formed in a generally L-shape in which the fitting cylindrical portion 33 is perpendicular to the wire lead-out port 35.

On an outer circumference of the fitting cylindrical portion 33, a unit packing 37 for waterproofly and dustproofly sealing between the fitting cylindrical portion and the equipment side shielded connector is mounted. An interlock 39 is disposed inside the fitting cylindrical portion 33 below the terminal fitting 25. The interlock 39 is adapted such that a detecting terminal 41 for electrically detecting a fitted state to the equipment side shield connector is mounted thereon.

The insulation housing 27 is covered with a pair of split shield shells 43. The split shield shells 43 are formed in a half-cylindrical shape and the insulation housing 27 is mounted therein. According to the present embodiment, the split shield shells 43 are constituted of a first split shield shell 45 and a second split shield shell 47. The first split shield shell 45 and the second split shield shell 47 are formed by a sheet metal processing using a conductive sheet metal material.

As shown in FIG. 2, the first split shield shell 45 covers a portion 49*a* (a left portion in FIG. 2) of a section of the insulation housing 27, which is intended to cover the wire lead-out port 35. Namely, the first split shield shell 45 covers an internal corner side of the insulation housing 27 formed in the generally L shape. Accordingly, the first split shield shell 45 is formed in a shape of a small cover adapted to cover only a portion of the wire lead-out port 35 in the insulation housing 27.

The second split shield shell 47 covers the other portion 49*b* (a right portion in FIG. 2) of the section of the insulation housing 27, which is intended to cover the wire lead-out port 35, and a body portion 51. Namely, the second split shield shell 47 covers an external corner side of the insulation housing 27 formed in the generally L shape. Accordingly, the second split shield shell 47 is formed in a shape of a box greater than the first split shield shell 45.

Therefore, the second split shield shell 47 of the present embodiment may seamlessly and integrally cover the other portion 49*b* of the section of the insulation housing 27, which is intended to cover the wire lead-out port 35, and the body portion 51, thereby achieving a good shield property.

As shown in FIGS. 1 and 3, bolt fixing portions 55, into which bolts 53 are inserted, are provided to protrude from both sides of the first split shield shell 45. The bolts 53 inserted in the bolt fixing portions 55 are fixed to bolt fastening portions 57 provided to protrude from sides of the second split shield shell 47 (see FIG. 4). The bolt fastening portions 57 may have female screws previously formed therein or may have nuts welded thereon. Alternatively, separate nuts may be screwed on the bolts 53.

On an outer surface of an upper portion of the insulation housing 27, a positioning boss 61 is provided. The positioning boss 61 is engaged with a positioning hole 63 provided in the second split shield shell 47. In other words, when the insulation housing 27 is covered with the split shield shells 43, the second split shield shell 47 is firstly positioned and maintained at a proper position of the insulation housing 27 by engaging the positioning hole 63 to the positioning boss 61 of the insulation housing 27. Then, the first split shield shell 45 is bolted to the second split shield shell 47, which is positioned and maintained on the insulation housing 27. Thus, the pair of split shield shells 43 is adapted to be positioned and fixed on the insulation housing 27 at high accuracy.

On sections of the split shield shells 43 intended to cover the wire lead-out port 35 of the insulation housing 27, from which the electric wires 19 are led out, annular mounting groove 65 is formed along a circumferential direction of the electric wires 19. The annular mounting groove 65 is press-formed as a groove-shaped portion 67 on each of both of the sections of the first and second split shield shells 45 and 47 intended to cover the wire lead-out port 35 of the insulation housing 27. In other words, the annular mounting groove 65 is configured by the groove-shaped portions 67 each recessed along the circumferential direction of the electric wires 19 on outer surfaces of a pair of first and second split shield shells 45 and 47 fitted and fixed to each other.

The annular mounting groove 65 is configured such that one (a groove wall on an end side) of sides thereof, between which a groove is sandwiched, becomes a flange portion 69. On the annular mounting groove 65, the end portion 17 of the braid 15 is mounted to climb over the flange 69 while surrounding the flange 69 from the outside. A fixing band 71, which is a braid fixing member, is fixed on an outside of the braid 15 mounted on the annular mounting groove 65. The fixing band 71 is fastened and fixed on the annular mounting groove 65 in a state where the end portion 17 of the braid 15 is disposed between the fixing band 71 and the annular mounting groove 65.

The fixing band 71 is formed by a thin metal plate material having a required strength. As shown in FIG. 1, the fixing band 71 is configured such that a band distal end 77 thereof is inserted in and fixed to a band fixation portion 75 provided on a band base end, thereby fastening the braid 15. Thus, a core as in a conventional fixing structure of a shielded cable is not required, and the braid 15 is fixed by only an external operation using a tool.

Meanwhile, according to the present embodiment, although the fixing band 71 made of the thin metal material is used as the braid fixing member, it will be appreciated that various fixing members (e.g., INSULOK (Trademark) or the like), such as tightening bands or fastening bands, made of synthetic resins or stainless steels may be used.

In the fixing structure of the shielded cable 11 using the fixing band 71, when the shielded cable 11 is assembled on the annular mounting groove 65, the braid 15, the annular mounting groove 65 and the electric wires 19 in this order are radially inwardly arranged in the inside. The annular mounting grooves 65 is covered on an outside surface thereof by the end portion 17 of the braid 15, and the core wires and the insulation covers 23 of the shielded cable 11 extend through an inside thereof. The fixing band 71 is fastened on an outer circumferential surface of the end portion 17, and thus the end portion 17 is sandwiched and fixed between the fixing band 71 and the annular mounting groove 65. In this time, because an inner diameter of the fixing band 71 becomes to be smaller than an outer diameter of the flange portion 79, the fixing band 71 and the braid 15 are prevented from falling out from the annular mounting groove 65.

Next, an assembling procedure of the shielded connector 13 will be described.

In order to assembly the shielded connector 13, the sheath 21 is firstly cut by a required length from one end of the shielded cable 11, thereby exposing the braid 15 and the electric wires 19. In addition, the shielded cable 11, whose one end has been connected to the terminal fitting 25, is led out from the wire lead-out port 35 of the insulation housing 27.

Then, one end side of the braid 15, which has been peeled from the insulation covers 23 covering the core wires, is expanded in a tapered shape. Also, a region of a predetermined length from the end of the braid 15 is folded inward or outward, thereby providing the end portion 17.

The second split shield shell 47 is temporally fixed to the insulation housing 27 by engaging the positioning hole 63 to the positioning boss 61, and then the first split shield shell 45 is fixed to the second split shield shell 47 by the bolts 53. By fixing the first split shield shell 45 and the second split shield shell 47 to each other, the insulation housing 27 is covered by the split shield shells 43. In addition, on the sections of the split shield shells 43 integrally fixed to each other, which cover the wire lead-out port 35, the annular mounting groove 65 are formed as described above.

Next, the end portion 17 of the braid 15 is sheathed to cover an outer circumference of the annular mounting groove 65. On the end portion 17 of the braid 15 mounted on the annular mounting groove 65, the fixing band 71 is fastened from the outside. By fastening the fixing band 71, the end portion 17 of the braid 15 is sandwiched and fixed between the fixing band 71 and the annular mounting groove 65, and as a result, fixation of the split shield shells 43 to the shielded cable 11 is completed.

Operations of the fixing structure of the shielded cable 11 having the foregoing configurations will be described.

In the fixing structure of the shielded cable 11 according to the present embodiment, the first split shield shell 45 and the second split shield shell 47 are fitted and fixed to each other, and thus the groove-shaped portions 67 each formed thereon constitute the annular mounting groove 65. The end portion 17 of the braid 15 is sheathed on the annular mounting groove 65 and the fixing band 71 is fixed from the outside of the end portion 17, so that the shielded cable 11 is fixed to the split shield shells 43 by a simple structure.

Also, the split shield shells 43 may be formed by a sheet metal material, and therefore, become lightweight and inexpensive, as compared to conventional shield shells manufactured by die-casting. In addition, the end portion 17 of the braid 15 sheathed on the annular mounting groove 65 is fastened by the fixing band 71 to be structurally prevented from falling out. Thus, assembly may be performed without using a core, crimping dies or the like for crimping and plastically deforming a conventional shield ring. Because crimping is not required, deformation of the split shield shells 43 is hardly occurred, and also an unstable grounding or a damage of the electric wires 19 due to contact between a deformed portion and the electric wires 19 is hardly occurred.

Thus, in the shielded connector 13 according to the present embodiment, because the annular mounting groove 65 is provided on a pair of split shield shells 43 constituted of the first and second split shield shells 45 and 47, a greater holding force for the fixing band 71 is not required. Namely, because the fixing band 71 is caught by the annular mounting groove 65, falling out of the braid 15 and the fixing band 71 may be concurrently prevented.

In addition, when the fixing band 71 is assembled, large facilities, such as a core or crimping dies, which has been conventionally used, are not required, but only a jig for fastening the fixing band 71 is enough, thereby also realizing cost reduction.

Therefore, the shielded connector 13 may be configured such that the end portion 17 of the braid 15 of the shielded cable 11 may be securely and inexpensively fixed by a simple structure.

Next, a fixing structure of a shielded cable according to a second embodiment of the present invention will be described. The same members and portions as those of the shielded connector 13 according to the first embodiment are designated by the same reference numerals, and accordingly, the repeated description thereof will be omitted.

Figure 4:
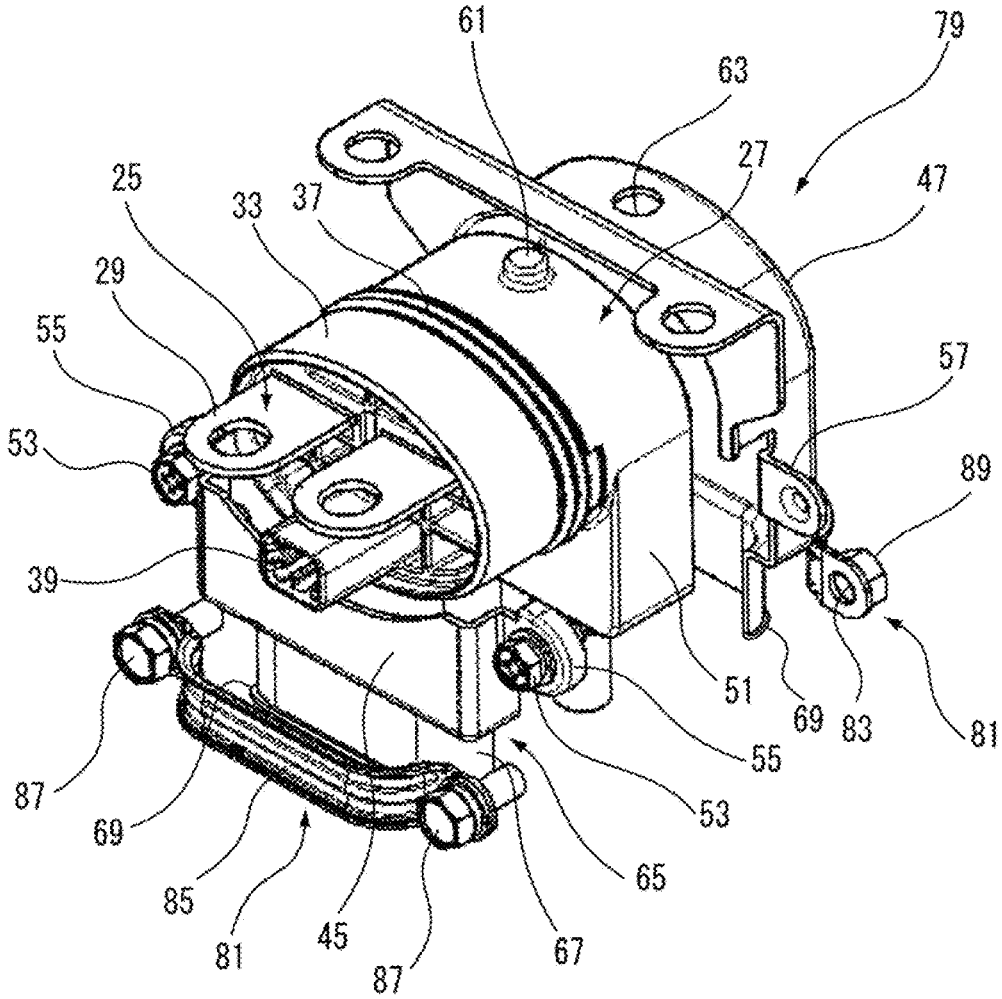
FIG. 4 is an exploded perspective view showing a shielded connector having a fixing structure of a shielded cable according to a second embodiment of the present invention.
Figure 5:
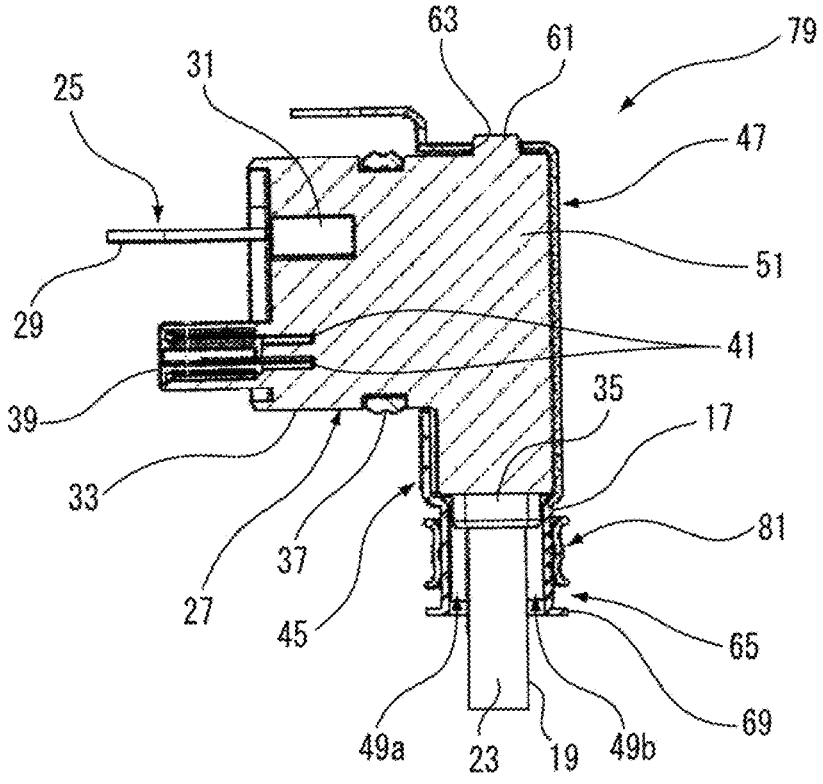
FIG. 5 is a longitudinal sectional view of the shielded connector shown in FIG. 4.
Figure 6:
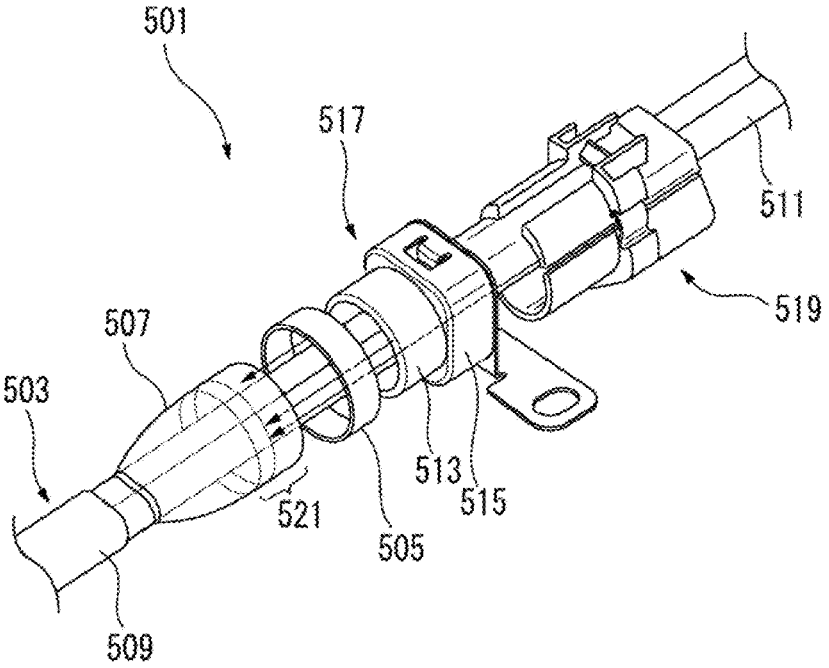
FIG. 6 is an exploded perspective view of a conventional shielded connector.
Figure 7:
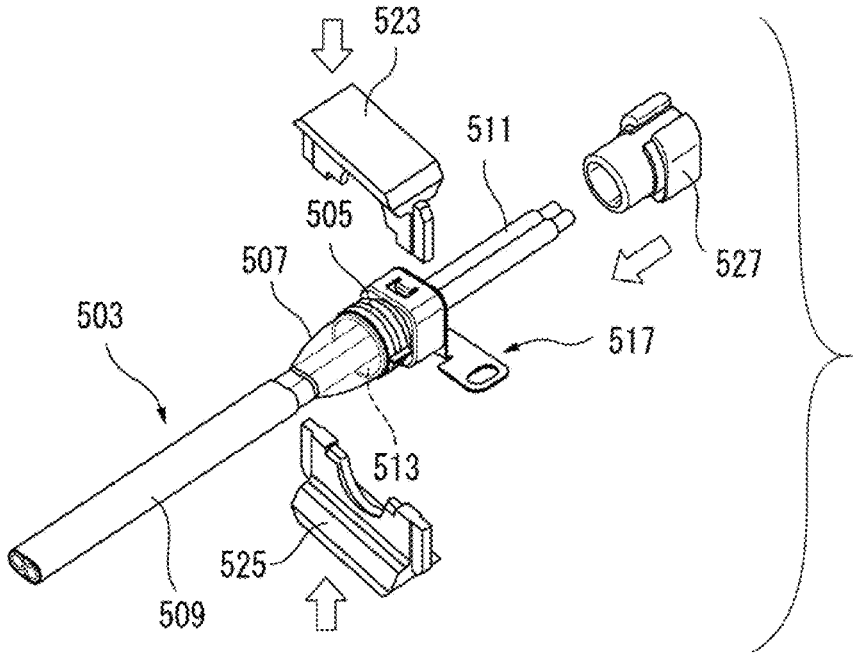
FIG. 7 is a perspective view showing an assembly situation of the shielded connector shown in FIG. 6.

As shown in FIGS. 4 and 5, in a shielded connector 79 having a fixing structure of a shielded cable 11 according to the second embodiment, a pair of fixing frames 81 fixed by a screw are used as the braid fixing member. The other configurations are identical to those of the shielded connector 13 of the first embodiment.

For the fixing frames 81, ones having the same shape on front and rear sides may be used in a pair. The fixing frames 81 have bolt insertion holes 83 formed on both ends thereof and a braid sandwiching portion 85 formed on the middle portion thereof.

In the fixing structure using the fixing frames 81, when the braid 15 is fixed, the end portion 17 of the braid 15 is sheathed to cover the annular mounting groove 65. The end portion 17 of the braid 15 mounted on the annular mounting groove 65 is sandwiched by the pair of fixing frames 81 from the front and back sides.

Then, bolts 87 are inserted into the bolt insertion holes 83 of each of the fixing frames 81 and nuts 89 are screwed on insertion distal ends of the bolts 87, thereby fastening the fixing frames 81 on the front and back sides to each other. By fastening the fixing frames 81, the end portion 17 of the braid 15 is sandwiched and fixed between the pair of fixing frames 81 and the annular mounting groove 65, and as a result, fixation of the split shield shells 43 to the shielded cable 11 is completed. Alternatively, the nuts 89 may be fixed to the bolt insertion holes 83 of one of the fixing frames 81.

Therefore, by the shielded connector 79 according to the second embodiment, the fixing structure of the shielded cable 11 is also simplified and component costs are reduced. Also, facilities used during assembly are reduced. In addition, connection stability is improved.

Here, features of embodiments of the fixing structure of the shielded cable according to the present invention will be respectively briefly summarized and listed in the following i to

[i] A shielded cable 11 fixing structure, including:

a shielded cable 11 including electric wires 19, a braid 15 for covering the electric wires 19, and a sheath 21 for covering the braid 15;

an insulation housing 27 for receiving a terminal fitting 25 electrically connected to the electric wires 19:

a pair of split shield shells (a first split shield shell and a second split shield shell) 45 and 47 formed in a half-cylindrical shape, wherein the insulation housing 27 is mounted inside the pair of split shield shells;

a groove-shaped portion 67 press-formed on a section of each of the split shield shells (the first split shell and the second split shield shell) 45 and 47 intended to cover a wire lead-out port 35 of the insulation housing 27, from which the electric wires 19 are led out, and thus recessed on an outer surface of each of the split shield shells along a circumferential direction of the electric wires 19 extending therethrough; and a braid fixing member (fixing band) 71 fastened and fixed on an annular mounting groove 65 constituted by the groove-shaped portions 67 of the pair of the split shield shells (the first split shell and the second split shield shell) 45 and 47 fitted and fixed to each other, in a state where an end portion 17 of the braid 15 is disposed between the annular mounting groove 65 and the braid fixing member.

[ii] The shielded cable 11 fixing structure according to the above [i], wherein the pair of split shield shells 43 (the first split shell and the second split shield shell) 45 and 47 include a first split shield shell 45 for covering a portion 49*a* of a section of the insulation housing 27, which is intended to cover the wire lead-out port 35, and a second split shield shell 47 for covering the other portion 49*b* of the section of the insulation housing 27, which is intended to cover the wire lead-out port 35, and a body portion 51.

[iii] The shielded cable 11 fixing structure according to the above [ii], wherein a positioning boss 61 is provided on an outer surface of the insulation housing 27 and is engaged to a positioning hole 63 provided on the second split shield shell 47.

Meanwhile, it will be appreciated that components, such as the electric wires, the braid, the sheath, the shielded cable, the terminal fitting, the insulation housing, the split shield shells, the groove-shaped portions and the braid fixing member, according to the shielded cable fixing structure of the present invention are not limited to the configurations of the foregoing embodiments, but may employ various configurations.

For example, the shape of the insulation housing is not limited to the generally L shape, but may be various shapes, such as a circular cylindrical shape or a prismatic shape, and the split shield shells may also have various shapes to correspond to the shape of the insulation housing.

This application is based on Japanese Patent Application No. 2011-144498 filed on Jun. 29, 2011, the entire contents of which are incorporated herein by reference.

Industrial Applicability

According to the shield cable fixing structure based on the present embodiment, the structure is simplified and component costs are reduced. Also, facilities used during assembly are reduced. In addition, connection stability is improved.

REFERENCE NUMERALS LIST

11 Shield cable
15 Braid
17 End portion
19 Electric wire
21 Sheath
25 Terminal fitting
27 Insulation housing
35 Wire lead-out port
43 Split shield shells
45 First split shield shell
47 Second split shield shell
51 Body portion
61 Positioning boss
63 Positioning hole
65 Annular mounting groove

67 Groove-shaped portions
71 Fixing band (Braid fixing member)
81 Fixing frames (Braid fixing member)

The invention claimed is:

1. A shielded cable fixing structure, comprising:

a shielded cable that includes an electric wire, a braid for covering the electric wire, and a sheath for covering the braid;

an insulation housing that receives a terminal fitting electrically connected to the electric wire;

a pair of split shield shells that is formed in a half-cylindrical shape, and in which the insulation housing is mounted;

a groove-shaped portion that is press-formed on a section of each of the split shield shells to cover a wire lead-out port of the insulation housing, from which the electric wire is led out, and is recessed on an outer surface of each of the split shield shells along a circumferential direction of the electric wire extending therethrough; and a braid fixing member that is fastened and fixed on an annular mounting groove constituted by the groove-shaped portions of the pair of the split shield shells fitted and fixed to each other, in a state where an end portion of the braid is disposed between the annular mounting groove and the braid fixing member.

2. The shielded cable fixing structure according to claim 1, wherein the pair of split shield shells include a first split shield shell for covering a portion of a section of the insulation housing, which is intended to cover the wire lead-out port, and a second split shield shell for covering the other portion of the section of the insulation housing, which is intended to cover the wire lead-out port, and a body portion of the insulation housing.

3. The shielded cable fixing structure according to claim 2, wherein a positioning boss is provided on an outer surface of the insulation housing and is engaged to a positioning hole provided on the second split shield shell.

* * * * *